US005211990A

United States Patent [19]

McKinney et al.

[11] Patent Number: 5,211,990

[45] Date of Patent: May 18, 1993

[54] POLYOLEFIN FLAME SPRAYING METHOD

[75] Inventors: Osborne K. McKinney; Randy S. Moore, both of Lake Jackson, Tex.; Alfred F. Castello, Newark, Ohio

[73] Assignee: The Dow Chemical Company, Midland, Mich.

[21] Appl. No.: 739,275

[22] Filed: Aug. 1, 1991

[51] Int. Cl.[5] ..... B05D 1/10

[52] U.S. Cl. ..... 427/447; 239/8

[58] Field of Search ..... 427/423, 447; 239/8, 239/85

[56] References Cited

U.S. PATENT DOCUMENTS

| | | | |
|---|---|---|---|
| 2,676,932 | 4/1954 | Deniston | 260/23 |
| 2,718,473 | 9/1955 | Powers | 427/195 |
| 2,962,387 | 11/1960 | Noeske et al. | 427/314 |
| 3,159,348 | 12/1964 | Wedan | 239/85 |
| 3,932,368 | 1/1976 | McConnell et al. | 260/78.4 D |
| 4,278,695 | 7/1981 | Velasco | 426/289 |
| 4,486,558 | 12/1984 | Guilbert | 523/466 |
| 4,528,319 | 7/1985 | Ottaviani et al. | 524/540 |
| 4,568,606 | 2/1986 | Hart et al. | 428/379 |
| 4,611,017 | 9/1986 | McKinney et al. | 524/119 |
| 4,632,309 | 12/1986 | Reimer | 239/8 |
| 4,769,289 | 9/1988 | Kelly et al. | 428/404 |
| 4,934,595 | 6/1990 | Reimer | 239/8 |
| 4,964,568 | 10/1990 | Rotolico et al. | 239/85 X |

FOREIGN PATENT DOCUMENTS

| | | | |
|---|---|---|---|
| 62-2866 | 1/1987 | Japan . | |
| 708352 | 5/1954 | United Kingdom | 427/423 |
| 9014895 | 12/1990 | World Int. Prop. O. . | |

OTHER PUBLICATIONS

Tech-Report, Metco/Perkin Elmer Sales Literature, 1986.

"Metco 6P-II Heavy-Duty Thermospray System", Metco/Perkin Elmer Sales Literature, 1984.

Metco Type 9MB, Metco, Inc. Sales Literature, 1982.

Uni-Spray-Jet, UTP Sales Literature, undated.

UTPlast F-311 Gun and Flame Spray System, UTP Sales Literature, undated.

Talen et al., Elsevier Sequoia Patent Reports, "Powder Coating", undated.

*Primary Examiner*—Evan Lawrence

[57] ABSTRACT

Improved plastic flame spray coating apparatus and methodology are disclosed. An inert gas is configured to shroud or envelop the pneumatically-conveyed stream of powdered plastic which is carried through the combustion flame. The polyolefin coating has increased adhesion and coating smoothness and thicker coatings without thermally-induced embrittlement, discoloration and poor mechanical properties are obtained.

10 Claims, 1 Drawing Sheet

POLYOLEFIN FLAME SPRAYING METHOD

FIELD OF THE INVENTION

This invention relates to a method and apparatus for flame spray coating a substrate surface with a carboxyl-containing polyolefin.

BACKGROUND OF THE INVENTION

Plastic flame spray coatings are generally prepared in the art from powdered plastic applied with a flame spray gun. The flame spray gun typically propels a central stream of pneumatically conveyed finely-divided thermoplastic material through a flame and onto the substrate surface to be coated. The thermoplastic becomes molten from the heat of the flame and is deposited onto a substrate surface where it cools and hardens to form a surface coating.

Flame spray guns are well known in the art. These guns are widely used for the application of metallic, ceramic and metallic-ceramic coatings. Typical of flame spray guns are, for example, the guns described in U.S. Pat. Nos. 4,934,595 and 4,632,309 to Reimer. In these guns, a stream of particulate material entrained in pressurized conveying air, a stream of pressurized combustion and propelling air, and a stream of fuel gas, are delivered in a concentric annular configuration to a combustion chamber such that the particulate material stream passes through a flame tunnel. Special considerations are given for enhancing the diameter and length of the flame tunnel to maximize the rate at which the particulate material can be applied to the substrate surface.

Plasma spray guns are also used, and differ primarily in that the particulated material is heated by passing it through hot plasma gas propelled from the gun in place of the oxy-fuel flame of the flame spray gun. International Publication WO 90-14895 describes an autogenic flame injection apparatus which can be used for either flame spraying or plasma application of powdered metals, ceramics, ceramic-metal mixtures and plastics.

In the present art, a variety of approaches are attempted in efforts to provide suitable plastic coatings made from thermoplastic materials. One approach is to employ plastic materials without inherent chemical functionality that can develop adhesiveness in the flame spray application, such as, for example, low density polyethylene. In this approach, applicators must successfully execute controlled oxidation of either or both the polymer composition and the substrate to gain adequate adhesion. For example, in U.S. Pat. No. 2,718,473 to Powers, anatase ($TiO_2$) was added to flame sprayed polyethylene powder to obtain controlled oxidation of the polyethylene to enhance adhesion of the resultant polyethylene coating. However, because of the stringently controlled temperature and oxidative conditions necessary to achieve successful coating, the use of polymer compositions without inherent chemical functionality has not been very successful commercially, particularly in field applications where such stringent control is frequently difficult if not impossible.

As another approach, it has been known to employ polymer compositions such as polyether imides, which are not inherently susceptible to thermal oxidation at practical thermal spray application temperatures. These high temperature materials, however, are very expensive and do not always have the inherent performance properties required or desired for specific protective coating and end-uses.

It has also been known to use inherently adhesive polymer compositions, such as those based on ethylene-acrylic acid copolymers. While this has some advantage over the unmodified polyethylene flame spray coating materials and is less expensive than the polyether imides, there remains much room for improvement.

A number of variables interplay in the application of flame spray thermoplastic coatings. For example, melt rheology and adhesion as previously noted, are of primary concern. In the flame spray application of thermoplastics, the substrate surface must generally reach a minimum "wet-out temperature" in order to obtain initial adhesion of the flame spray coating material. A low melt viscosity is generally desirable in order to reduce the wet-out temperature and impart initial adhesion. On the other hand, if the melt viscosity is too low, the molten plastic may, for example, run or ripple before cooling such that there are defects in the resultant coating. Also, lower melt viscosity polyolefins will have lower average molecular weights and concomitantly inferior mechanical properties.

The coating thickness is also a concern. Generally, the thicker the coating, the better the coating performance, i.e. in terms of corrosion resistance, durability and protection of the surface. In order to obtain a thicker coating, however, the flame spray must be directed to the surface for a longer period of time to allow more material to be deposited. In turn, the longer the exposure of the surface to the flame spray, the higher the temperature of the coating which is reached during its deposition. If the temperature is too high, then the desirable properties of the polymer can be adversely affected by polymer degradation, and in severe cases burning or scorching may occur. Conversely, the higher the upper temperature on the coating before properties are adversely affected, the thicker the coating which can be achieved in one application. When the plastic cannot be laid down thick enough in an initial coating, subsequent passes may be required to lay the plastic down in a number of layers. This has the inherent disadvantages of requiring additional labor and creating stresses in the coating between the various layers of the plastic which can lead to undesirable defects in the overall plastic coating.

Additionally, the properties of the plastic coating are a major concern. Desirable properties include thickness and adhesion, as previously mentioned, and also other mechanical and surface properties such as smoothness, gloss, impact strength and the avoidance of pinholes. Accordingly, the selection of coating materials and application techniques is dictated by the desired properties of the resulting coating. It is also desirable to facilitate the coating application process. The application rate is of economic importance, of course, in order to minimize the time and labor that it takes to form the coating on the surface.

The ease of application is also important from the standpoint that the process variables should allow for a wide margin of error or "forgiveness" in their selection. This would have the direct result that the flame spray coating can be applied in a wider variety of situations and environmental extremes without operator difficulty.

In conventional thermal spray systems for plastics, the applicators must contend with relatively narrow temperature "application windows" or "envelopes."

For example, on the low thermal input end, i.e., not enough heating of the polymer, substrate adhesion can be low or marginal due to insufficient polymer melting and/or substrate wetting, and pinholing can occur due to poor particle-to-particle coalescence on the substrate surface. On the other hand, if the plastic is overheated in the flame, excessive crosslinking can result in higher melt viscosity, poor melt flow, reduced cohesive strength, low adhesion, discoloration and scorching, and pinholing can also result from out-gassing of degradation by-products and/or poor particle-to-particle coalescence arising from high melt viscosity.

The effect of the particle size of the plastic flame-sprayed from the gun has also been noted. For example, Japanese Patent Publication No. 62-2866 (1979) describes a flame spraying operation using a modified polyethylene containing 0.01 to 10 parts by weight, per 100 parts by weight of the polyethylene, of an unsaturated carboxylic acid or anhydride, having a melt tension from 0.5 to 15 g, and a particle size distribution from 30 to 200 mesh. It was reported that particle diameters smaller than 200 mesh result in the formation of air bubble voids in the coating, but that particle diameters exceeding (larger than) 30 mesh lead to nonuniform coatings which are not smooth and have an inferior "orange peel" appearance.

Various methods of obtaining small particles of polyolefins for coatings have been used. For example, U.S. Pat. No. 3,932,368 to McConnell describes the cryogenic grinding of carboxylated polyolefins to less than about 20 mesh size for coating substrates using a fluidized wet coating process, and to less than about 100 mesh size for electrostatic spray coating. This patent also describes the use of thermal, oxidative and ultraviolet radiation stabilizers in the powdered polyolefin.

The flame spray coating technique has been used with polyethylenes containing other additives, and with chlorinated polyethylenes. This is illustrated by U.S. Pat. No. 2,962,387 to Noeske, which describes the flame spray application of chlorinated polyethylenes with a critical chlorine content to minimize shrinkage of the coating following its application, and by U.S. Pat. No. 2,676,932 to Deniston, which describes a flame spraying composition containing polyethylene and a diethylene glycol stearate wax.

SUMMARY OF THE INVENTION

The present invention pertains to a method and apparatus for flame spray coating a carboxyl-containing polyolefin composition onto a substrate surface, wherein the polyolefin is sprayed and heated in an oxygen-lean environment. By the present invention, oxidative degradation of the molten polyolefin is inhibited, and higher coating application temperatures, thicker coatings, quicker application of the coating and improved coating properties are obtainable.

In one aspect, the present invention provides an improved method of flame spray coating a carboxyl-containing polyolefin onto a substrate surface. The method includes the steps of: (1) forming a flame by supplying a continuous stream of fuel to a fuel discharge port of a flame spraying nozzle at a rate to sustain combustion of the fuel; (2) pneumatically conveying fluidized, finely-divided polyolefin to the nozzle; (3) discharging the fluidized polyolefin from the nozzle through the flame in an oxygen-lean environment to form a molten polyolefin spray; and (4) directing the molten polyolefin spray onto a substrate surface to deposit a coating of the polyolefin onto the substrate surface. The polyolefin comprises from about 0.1 to about 55 percent by weight of a carboxyl-containing monomer. The polyolefin can also contain heat stabilizing and/or fluid flow additives, and preferably has a particle size less than about 297 microns. The oxygen-lean environment is generally formed with inert gas, for example, nitrogen, helium, argon, carbon dioxide, steam or a combination thereof. The inert gas can be supplied as at least a portion of the gas used for fluidizing the polyolefin and/or in the form of a shroud formed between the polyolefin discharge stream and the flame. The oxygen-lean environment of the polyolefin discharge preferably has an oxygen content less than about 5 percent.

In another aspect, the present invention provides an apparatus that can be used in the novel flame spray coating method set forth above.

DETAILED DESCRIPTION OF THE INVENTION

The flame spray coating apparatus used herein includes a polyolefin supply reservoir, a flame spraying nozzle, a fuel source and a pneumatic conveying conduit. The polyolefin supply reservoir contains a charge of finely-divided carboxyl-containing polyolefin. The conveying conduit is adapted to supply the polyolefin in fluidized form from the reservoir to a polyolefin discharge port of the nozzle. The nozzle includes a fuel discharge port adapted to form a flame, and the polyolefin discharge port is adapted to discharge a stream of finely-divided polyolefin adjacent the flame to form a molten polyolefin spray directable onto a substrate surface to form a polyolefin coating thereon. The fuel source is adapted to continuously supply fuel to the discharge port at a rate to sustain the flame. Means are provided for forming an oxygen-lean environment adjacent to the polyolefin discharge stream which effectively inhibits oxidative degradation of the molten polyolefin.

In a further embodiment, the flame spraying apparatus has a nozzle at which an outer annular flame tunnel is formed by combustion of fuel and an oxidizing gas continuously discharged from the nozzle at a rate to sustain the flame tunnel. The apparatus includes a central discharge from the nozzle of a fluidized stream of finely-divided, carboxyl-containing polyolefin. An annular inert gas shroud is disposed in the flame tunnel around the central polyolefin stream. The shroud comprises an inert gas containing less than about 5 percent by weight oxygen supplied at a rate to provide a weight ratio of the inert gas shroud to the oxidizing gas of at least about 0.75, preferably at least about 1, and especially at least about 3. The apparatus can produce a spray of molten polyolefin formed by passage of the polyolefin discharge stream through the flame tunnel.

Figure 1:
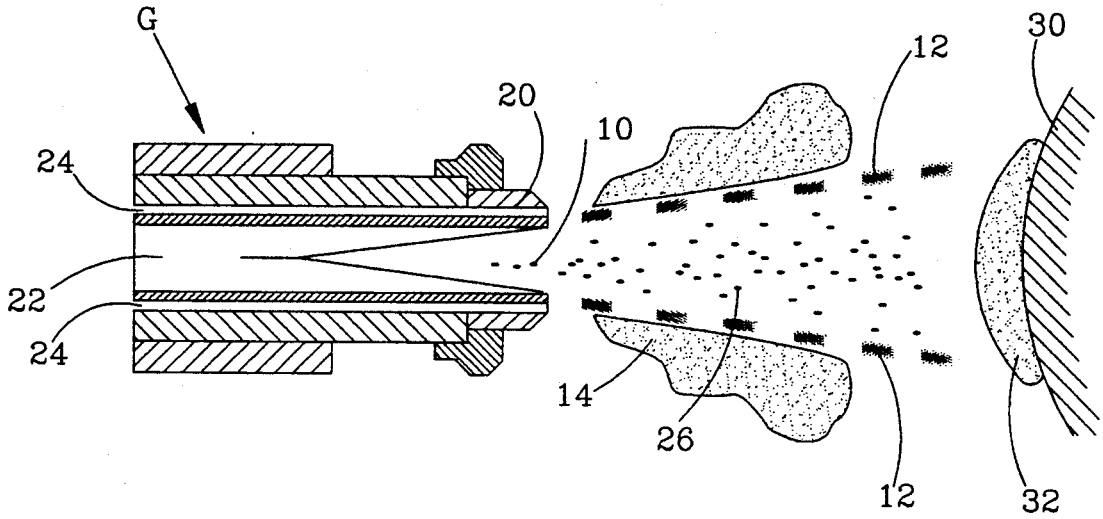
FIG. 1 is a side view schematic of a flame spraying gun in accordance with the present invention.
Figure 2:
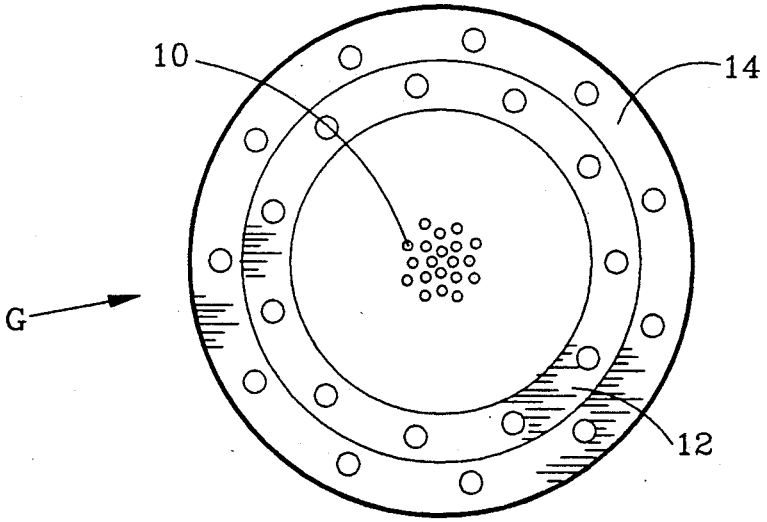
FIG. 2 is a schematic nozzle frontal view of the gun of FIG. 1.

With reference to FIGS. 1 and 2, the flame spraying gun C propels a central powdered plastic/carrying gas stream 10 which is concentrically surrounded by an inert gas shroud 12 and an oxygen-fuel flame 14. The gun nozzle 20 includes inert gas feed 22 and fuel/oxygen feed 24. The flame 14 is in the form of a tunnel surrounding the inert gas shroud 12 through which the powdered plastic stream 10 passes to form a quasi-molten plastic particulate stream 26. The molten stream 26 is directed to the surface of substrate 30 to form a thermal spray coating 32 thereon.

The present invention employs an oxygen-lean environment which excludes, or at least significantly reduces oxygen availability at the molten polymer interfaces that exist through the flame and at the substrate surface. Oxidative crosslinking is thereby minimized and, surprisingly, the thermal spray application "window" for the polyolefin being applied is widened. The ratio of heat supplied to plastic sprayed is therefore not as critical in the present invention as in the prior flame spray techniques. A wider application window also yields a more forgiving coating process in that the operator has greater latitude in controlling the coating thickness and/or flame temperatures. Moreover, substrate adhesion and coating smoothness are enhanced, or at least more easily obtained.

Flame spraying guns which can be used in the present invention are well known and many are even commercially available, for example, from Metco, Inc., a subsidiary of Perkin Elmer Corp.; U.T.P. Welding Materials, Inc.; and Plastic Flamecoat Systems, Inc. The guns described in aforementioned U.S. Pat. Nos. 4,934,595 and 4,632,309 and International Publication WO 90-14895, which are hereby incorporated herein by reference, are further examples.

The flame, preferably in the form of an annular "tunnel" can be formed by the combustion of any suitable fuel such as, for example, propane, hydrogen, acetylene, natural gas, butane, methane, propylene, ethylene, coke-oven gas, blast-furnace gas, refinery oil gas, carbureted water gas, combinations thereof and the like. Oxygen is provided at a rate sufficient to sustain the flame and is conveniently provided in the form of compressed air or oxygen which is mixed with the fuel at or before the spray gun nozzle.

Suitable inert gases which are supplied to form the oxygen-lean environment adjacent to the flame of the thermal spray gun include nitrogen, helium, argon, carbon dioxide, steam, or the like, and combinations thereof, and nitrogen is preferred, based on commercial availability and ease of handling. Although inert gases containing minor proportions of oxygen have applicability for the purposes of the present invention, the inert gas is preferably substantially free of oxygen. The supply of a reduced-oxygen-content, inert gas is effective at a rate which results in the inhibition of oxidative polymer cross-linking. The weight ratio of shrouding gas flow to the oxidizing gas is generally at least about 0.75, preferably at least about 1.0, and especially at least about 3.0. The only disadvantage of using higher inert gas rates is an increase in fuel requirements.

The substrate surface is desirably clean and oil-free, and grit blasting of metal surfaces, for example, to a profile of 38–50 microns (1.5–2 mils), has been found to enhance polymer adhesion. The flame spray gun is generally used with the flame only (without spraying any plastic) to preheat the substrate surface to the wet-out temperature, usually a skin temperature of about 75°–80° C. The inert gas shroud and the polymer are then supplied to the nozzle and the surface is coated by moving the spray path across the substrate surface at a speed slow enough to form the desired coating thickness, but fast enough to avoid localized heat buildup and concomitant coating damage. Application rates exceeding 10 $m^2$/hr have been achieved. Polymer degradation which may adversely affect the coating properties cannot always be detected visually, and it is advisable to use an optical pyrometer for surface temperature observations and for referencing conditions known to be satisfactory. Wet-out and polymer degradation (e.g. excessive crosslinking and scorching) temperatures depend on the specific polymer being sprayed. Spark testing for pinholes may be desirable, particularly where the coated surface is subject to chemical immersion or used in corrosion control service. The coating thickness is preferably at least about 500 microns, and single-pass coating thicknesses of up to 1.5 mm have been obtained.

The carboxyl-containing polyolefins which are suitable for use in the present invention are a known class of olefin polymers which have a carboxyl content from about 0.1 to about 55, preferably from about 0.25 to about 35, and especially from about 0.5 to about 25 percent by weight of carboxyl-containing moieties. Such polyolefins have a melt index (ASTM D-1238, condition 190° C./2.16 kg unless otherwise noted) of less than about 1500 dg/min, preferably from about 0.5 to about 100 dg/min.

The carboxyl-containing polymers can be prepared by interpolymerizing one or more α-olefins having from 2 to about 20, preferably from 2 to about 12, and more preferably from 2 to about 8 carbon atoms, with at least one polymerizable ethylenically unsaturated monomer containing a carboxyl moiety in accordance with well known interpolymerization techniques. Suitable α-olefins include, for example, ethylene, propylene, 1-butene, 3-methyl-1-butene, 1-pentene, 4-methyl-1-butene, 1-hexene, 1-octene, 1-nonene, 1-decene, 1-dodecene, 1-octadecene, combinations thereof, and the like. Particularly suitable are ethylene and mixtures of ethylene and at least one other α-olefin having from about 3 to about 8 carbon atoms.

Suitable carboxyl-containing moieties include, for example, polymerizable ethylenically unsaturated acids and anhydrides, polymerizable ethylenically unsaturated salts of aliphatic acids, polymerizable ethylenically unsaturated esters including vinyl alcohol esters, and metal salt or metal hydroxide neutralized derivatives thereof, combinations thereof and the like. Particularly suitable carboxyl-containing monomers include, for example, acrylic acid, methacrylic acid, t-butylacrylate, vinyl acetate, crotonic acid, succinic anhydride, maleic anhydride, methyl methacrylate, vinyl isobutyrate, combinations thereof and the like. Suitable metal salts thereof include, for example, salts formed from zinc oxide, magnesium oxide, sodium dioxide, aluminum trioxide, combinations thereof and the like, while suitable metal hydroxides for salt formation include, for example, zinc hydroxide, sodium hydroxide, aluminum hydroxide, magnesium hydroxide, cesium hydroxide, potassium hydroxide, combinations thereof and the like.

Alternatively, the carboxyl-containing polyolefins can be prepared by modifying a polyolefin by chemical and/or extrusion grafting techniques well known in the art.

Preferred carboxyl-containing polyolefins are ethylene/acrylic acid copolymers, ethylene/methacrylic acid copolymers, and ionomers thereof. Such polymers are available commercially under the trade designations PRIMACOR, SURLYN, NUCREL, ESCORENE, YUKALON and HIMYLAN.

The carboxyl-containing polyolefin can, and preferably does, contain one or more heat stabilizing additives to further aid in minimizing thermal oxidative degradation of the polymer during the flame spray coating operation. Representative examples of such stabilizers include phosphites, hindered phenols, organophosphorus compounds, dicarboxylic acids, tricarboxylic acids and the like. For example, U.S. Pat. No. 4,611,017 to McKinney describes the general use of aromatic bis(organophosphorus) compounds with or without a hindered phenol antioxidant and/or a dicarboxylic acid, to improve the oxidative, process and/or color stability of carboxyl-containing ethylene interpolymers in conventional finishing operations such as extrusion, molding, blowing and the like, and is hereby incorporated herein by reference. The thermal stabilizing compounds are used at an effective concentration, i.e., to obtain a flame sprayed coating having a melt index of at least 70 percent of the melt index of the polymer prior to flame spraying. The heat stabilizer is preferably included in the carboxyl-containing polyolefin in an amount up to about 5 percent by weight, more preferably up to about 1 percent by weight, and especially from about 0.05 to about 0.5 percent by weight based on the weight of the polyolefin resin. The additives are generally uniformly distributed throughout the polyolefin using conventional polymer blending techniques preferably by melt compounding prior to size reduction.

The carboxyl-containing polyolefin may contain other additives if desired, such as UV stabilizers, colorants, pigments, flow additives, and the like, which do not substantially affect flame sprayability.

The polyolefin is finely-divided to facilitate conveying and spraying. The polyolefin can be comminuted into fine powder by any one of several well-known techniques such as, for example, solution precipitation, air milling, hammer milling, rotor milling, attrition milling, solution spray drying, post-reactor cold-gas quenching and the like. Cryogenic grinding below the polyolefin brittle point is a preferred embodiment, for example, with liquid nitrogen in a hammer mill. Classification, e.g. by screening, can be used to remove fines and/or oversized particles to obtain the desired particle size range.

The carboxyl-containing polyolefin preferably has a particle size distribution to facilitate application of a relatively thick coating. It has been found that desirably thick coatings can be achieved by using a particle size which is relatively smaller than the particle sizes generally employed in prior flame spraying procedures, provided that thermal oxidative degradation of the polyolefin is suitably inhibited, by the use of the oxygen-lean environment and/or a relatively high thermal stabilizing additive content. Smaller particle sizes have the inherent advantage of providing smoother plastic coating surfaces. A size range from about 37 microns (400 mesh) to about 297 microns (50 mesh) is preferred.

The preferred particle size distribution depends in large part on the specific polyolefin being flame sprayed. For example, with an interpolymer of ethylene and from 3 to about 16 percent by weight of acrylic or methacrylic acid having a melt index from about 0.01 to about 100, best results have been obtained with a particle size distribution substantially between about 37 microns to about 177 microns, with at least about 95 weight percent less than about 177 microns and at least about 85 weight percent less than about 149 microns (100 mesh). However, with higher acid-content polyolefins (e.g., from about 16 to about 22 percent by weight) with relatively high melt indices (e.g. from about 100 to about 1500), the preferred particle size ranges substantially between about 37 microns to about 300 microns (50 mesh), with at least about 85 weight percent less than about 210 microns (70 mesh) and at least about 75 weight percent less than about 149 microns. Similarly, with maleic anhydride-grafted polyolefins (e.g., low density polyethylene, high density polyethylene, linear low density polyethylene, polypropylene, etc.) having a maleic anhydride graft level of from about 0.05 to about 5 percent by weight and a melt index from about 0.5 to about 50, the preferred particle size range is substantially between about 37 to about 149 microns, with at least about 95 weight percent less than about 149 microns.

Flow improvement additives, such as inorganic fillers, are generally added to the particulated polyolefin, prior to use in the flame spray coating operation. The inorganic filler preferably has an average particle size in the range of from about 0.001 to about 1 micron, and is surface treated with a normally solid low molecular weight polar compound such as, for example, fatty acid amide, fatty acid amine, hindered amine, carboxylic acid, oxidized polymer wax and the like, e.g. oleamide and citric acid. As examples of inorganic fillers, there may be mentioned carbonates, silicas, talcs, clays, metal salts, aluminates, titanates and the like. Particularly suitable inorganics include silica gel, fumed silica, silicon dioxide, calcium carbonate, antimony trioxide, sodium silica-aluminate, titanium dioxide, zinc oxide, quartz, calcium stearate and the like. The general use of silica to enhance the flow characteristics of various polymers and other materials is described, for example, in U.S. Pat. Nos. 4,769,289 to Kelly; 4,568606 to Hart; 4,528,319 to Ottaviani; 4,486,558 to Guilbert; and 4,278,695 to Velasco.

A wide variety of substrate surfaces, especially metals, can be flame spray coated under a wide variety of environmental conditions. Suitable substrates include aluminum, carbon steel, stainless steel, concrete, asphalt, wood, plastics, fiberglass, paper and the like. For example, the present invention can be used to apply flame spray coatings to pipe interiors and exteriors, fuel tanks, chemical processing and storage vessels, transport vessels, ice-breakers, and similar industrial and marine surfaces, to name just a few.

EXAMPLES

In the following examples, coating smoothness was evaluated with respect to the presence and extent of orange peel as an objectionable coating surface defect. A "Smoothness Rating" criteria was used as follows:

| Smoothness Rating | Criteria |
|---|---|
| 1 | Gross orange peel and surface roughness; detectable by sight and feel |
| 2 | Excessive orange peel; detectable by sight and feel |
| 3 | Moderate orange peel; detectable by sight and sometimes by feel |
| 4 | Some orange peel; detectable by sight only |
| 5 | No or very slight orange peel; detectable by sight only |

Polymer A was an ethylene-acrylic acid copolymer containing 9.6 weight percent acrylic acid in interpolymerized form and having about 200 ppm of a stabilizer IRGANOX 1010 and a melt index (MI of 3.3 dg/min.

Polymer B was an ethylene-acrylic acid copolymer containing 9.7 weight percent acrylic acid with about 200 ppm IRGANOX 1010 and a 20.8 MI. Polymer C was an ethylene-vinyl acetate copolymer 20 percent neutralized with sodium hydroxide and having a 32 MI.

The "Practical Application Window" is the difference between the wet-out temperature and the maximum coating temperature before significant thermal degradation occurs and is an indication of the temperature range at which the plastic coating may be applied. It is determined qualitatively as follows:

$$\text{Practical Application Window} = k\,(\text{Final Coating Temperature} - \text{Wet-Out Temperature})\,\frac{(\text{Gardner Impact})}{(\text{Coating Thickness})}$$

wherein k is a constant depending on the polymer material and units of Gardner impact and coating thickness. For Polymer A and B, where Gardner impact is in N-m and the coating thickness is in millimeters, k is equal to 0.0187; and for Polymer C, to 0.0234. The constant k is basically the ratio of impact strength to coating thickness over the range of coating temperatures where there is no thermal oxidative degradation.

PREPARATION OF POWDERED COATING COMPOSITION

Dry-blends of Polymer A and Polymer B with 0.20% by weight of tetrakis[methylene (3,5-di-tert-butyl-4-hydroxy hydrocinnamate)]-methane and 2.75% by weight of a black pigment formulation were melt-compounded in a 50 mm Werner-Pflieder twin-screw corotating extruder at about 185° C. The resultant extrudate was cryogenically ground using liquid nitrogen and a MIKRO-PUL hammer mill and then screen classified with a ROTO-TAP lab sieve unit to provide a finely powdered polymer composition with a natural size distribution of about 96.5% of the particles by weight in the size range of 37–177 microns (80–400 mesh).

Comparative Example I

The cryogenically ground Polymer A composition was flame spray coated onto a 7.6 cm×12.7 cm×0.32 cm (3"×5"×⅛") steel grit blasted cold-rolled steel plate with a 0.038–0.051 mm 1.5–2.0 mil) profile using a UniSpray Jet flame-spray gun supplied by UTP Welding Materials, Houston, Tex. The UniSpray Jet unit was fueled at a neutral (N) setting by propane set at 39 kPa (5.6 psi) and oxygen set at 262 kPa (38 psi), and the powder was carried by dry air set at 345 kPa 50 psi). At a pre-heat temperature of 78° C. (172° F.), a polymer coating with inseparable adhesiveness and good coating smoothness without visible discoloration (i.e., ≧17.2 MPa (2,500 psi) by Dolly-Elcometer measurement and a 4.0 Smoothness Rating, respectively) was prepared with a thickness of 0.475 mm (18.7 mils) in the temperature range of 161°–213° C. (322°–415° F.). Also, no pinholes were detected, 60° Gloss was 55% and Gardener drop-dart impact strength was 28.5 N-m (21 ft-lbs). The pre-heat and coating temperature determinations were made using a Raynger ST4 Optical Pyrometer supplied by Raytek (Santa Cruz, Calif.) and the coating thickness determinations were made using a FischerScope Multipoint Tester supplied by Fischer (W. Germany). The flame spraying conditions and coating properties are set out in Table I.

Comparative Example II

In a second coating application with the same Polymer A composition and gun settings as above and at a 76° C. (169° F.) substrate pre-heat temperature, the coating temperature reached 227° C. (441° F.) for a resultant coating which was slightly scorched and discolored and had a thickness of 0.630 mm (24.8 mils). The Dolly-Elcometer adhesion was 10.7 MPa (1,550 psi), pinhole testing with a DE Stearns Spark Tester at 3,500 V indicated 5 pinholes, the Gardener Glossometer measured 38 percent at 60° Gloss, Gardener impact strength was 23 N-m (17 ft-lbs) and the coating had a visual Smoothness Rating of 2.5. The impact reduction was very significant because impact resistance typically increases proportionately with increased coating thickness. This example showed that the practical maximum coating thickness of this composition and equipment configuration was less than 0.63 mm, and that an acceptable single-pass coating of 0.63 mm could not be obtained under these conditions. The flame spraying conditions and coating properties are set out in Table I.

Inventive Example I

In a third coating application on identical steel plate with the cryogenically ground Polymer A powder composition, the Uni-Spray Jet unit (which is engineered with an auxiliary gas inlet intended to provide cooling for flame spray coating with powdered metals and ceramics, and is configured concentrically between the material stream and the flame) was outfitted with nitrogen set at 207 kPa (30 psi) and fueled at a neutral (N) setting by propane set at 39 kPa (5.6 psi) and oxygen set at 270 kPa (39 psi), and the powder was carried by dry air set at 345 kPa (50 psi). A thermal spray coating was produced using a pre-heat temperature of 79° C. (174° F.) at 1.08 mm (42.6 mils) whereby the measured coating temperature reached 250° C. (482° F.) without any signs of scorching or discoloration. Dolly-Elcometer adhesion was ≧17.2 MPa (2,500 psi), pinhole testing with a DE Stearns Spark Tester at 3,500 V indicated 0 pinholes, the Gardener Glossometer measured 58 percent at 60° Gloss, Gardener impact strength was 63 N-m (46 ft-lbs), and the coating had a visual Smoothness Rating of 5.0. This example showed the dramatic increase in coating thickness which could be obtained at these conditions by supplying an inert gas shroud, and also showed enhancement of the coating properties (smoothness and impact strength). The flame spraying conditions and coating properties are set out in Table I.

Inventive Example II

The procedure of Inventive Example I was repeated with an increased nitrogen flow rate to the inert gas shroud. The flame spraying conditions and coating properties are set out in Table I. Increasing the nitrogen flow rate to the inert gas shroud had the surprising effects of broadening the practical application window temperature, increasing the achievable coating thickness, and further enhancing impact strength and gloss.

Comparative Examples III and IV and Inventive Example III

Flame spraying application of the cryogenically ground Polymer B composition was evaluated in a fashion similar to that of Comparative Examples I and II and Inventive Example I above. The flame spraying conditions and coating properties are set out in Table I. Comparative Examples III and IV, without any inert gas shrouding, resulted in a maximum suitable coating thickness between 0.676 mm (26.6 mils) (Comparative Example III) where the coating properties were generally acceptable (noting, however, the low impact strength corresponding to the relatively thin coating), and 0.792 mm (31.2 mils) (Comparative Example IV) where the coating appeared to be unacceptable in adhesion, smoothness, gloss and the number of pinholes. In striking contrast, when the inert gas shroud was used in Inventive Example III, the practical application window was nearly doubled, and a coating thickness of 1.45 mm (56.9 mils) could be obtained which had acceptable adhesion, smoothness, impact and gloss properties, without pinholes.

TABLE I

| SETTING/COATING PERFORMANCE | COMPARATIVE EXAMPLE I | COMPARATIVE EXAMPLE II | INVENTIVE EXAMPLE I | INVENTIVE EXAMPLE II | COMPARATIVE EXAMPLE III | COMPARATIVE EXAMPLE IV | INVENTIVE EXAMPLE III |
|---|---|---|---|---|---|---|---|
| POLYMER | A | A | A | A | B | B | B |
| PROPANE WEIGHT FLOW, kg/hr | 2.8 | 2.8 | 2.8 | 2.8 | 2.6 | 2.6 | 2.6 |
| OXYGEN WEIGHT FLOW, kg/hr | 7.3 | 7.3 | 7.3 | 7.3 | 6.6 | 6.6 | 6.6 |
| CARRYING AIR WEIGHT FLOW, kg/hr | 7.9 | 7.9 | 7.9 | 7.9 | 7.9 | 7.9 | 7.9 |
| NITROGEN WEIGHT FLOW, kg/hr | 0 | 0 | 5.9 | 7.3 | 0 | 0 | 6.1 |
| WET-OUT TEMPERATURE, °C. | 161 | 159 | 159 | 163 | 152 | 153 | 150 |
| FINAL COATING TEMPERATURE, °C. | 213 | 227 | 250 | 255 | 219 | 236 | 252 |
| PRACTICAL APPLICATION WINDOW, °C. | 59 | 46 | 98 | 98 | 61 | 73 | 138 |
| COATING THICKNESS, mm | 0.475 | 0.630 | 1.08 | 1.19 | 0.676 | 0.792 | 1.45 |
| DOLLY-ELCOMETER ADHESION, MPa | ≧17.2 | 10.7 | ≧17.2 | ≧17.2 | ≧17.2 | 11.5 | ≧17.2 |
| SMOOTHNESS RATING | 4.0 | 2.5 | 5.0 | 5.0 | 5.0 | 3.0 | 5.0 |
| GARDENER IMPACT, N-m | 29 | 23 | 62 | 68 | 33 | 30 | 81 |
| 60° GARDENER GLOSS (%) | 55 | 38 | 58 | 60 | 62 | 49 | 65 |
| PINHOLES @ 3,500 volts | 0 | 5 | 0 | 0 | 0 | 7 | 0 |

Polymer A: 9.6% AA, 3.3 MI Copolymer with ~200 ppm Irganox 1010
Polymer B: 9.7% AA, 20.8 MI Copolymer with ~200 ppm Irganox 1010

Comparative Examples V and VI and Inventive Example IV

A similar set of examples was conducted using the cryogenically ground Polymer C composition. The flame spraying conditions and coating properties are set out in Table II. Without inert gas shrouding as seen in Comparative Examples V an VI, the coating thickness was low (0.544 mm in Comparative Example V) or the coating properties were unsuitable (note the relatively low adhesion, smoothness rating, impact strength and gloss, and the excessive number of pinholes of Comparative Example VI). Also, without the inert gas shrouding, the practical application window was relatively narrow. In contrast, in Inventive Example IV where inert gas shrouding was employed, a relatively thick coating could be achieved which had improved adhesion, smoothness, impact strength and gloss relative to the non-shrouded Comparative Examples V and VI. Also, the practical application window range was significantly greater with the inert gas shrouding in Inventive Example IV than in the non-shrouded Comparative Examples V and VI.

TABLE II

| SETTINGS/ COATING PERFORMANCE | COMPARATIVE EXAMPLE V | COMPARATIVE EXAMPLE VI | INVENTIVE EXAMPLE IV |
|---|---|---|---|
| POLYMER | C | C | C |
| PROPANE WEIGHT FLOW, kg/hr | 2.3 | 2.3 | 2.3 |
| OXYGEN WEIGHT FLOW, kg/hr | 5.0 | 5.0 | 5.0 |
| CARRYING AIR WEIGHT FLOW, kg/hr | 7.9 | 7.9 | 7.9 |
| NITROGEN WEIGHT FLOW, kg/hr | 0 | 0 | 6.1 |
| WET-OUT TEMPERATURE, °C. | 174 | 171 | 174 |
| FINAL COATING TEMPERATURE, °C. | 231 | 246 | 248 |
| PRACTICAL APPLICATION WINDOW, °C. | 43 | 31 | 73 |
| COATING THICKNESS, mm | 0.544 | 0.917 | 0.876 |
| DOLLY-ELCOMETER ADHESION, MPa | 10.5 | 6.72 | 11.5 |
| SMOOTHNESS RATING | 4.5 | 1.5 | 5.0 |
| GARDENER IMPACT, N-m | 22 | 16 | 37 |
| 60° GARDENER GLOSS (%) | 44 | 26 | 51 |
| PINHOLES @ 3,500 volts | 0 | 9 | 0 |

Polymer C: Ethylene-vinyl acetate copolymer 20% neutralized with NaOH and having a 32 g/10 min Melt Index at 190° C.

Inventive Example V

A dry-blend of an ethylene-acrylic copolymer having 3.2 MI and an acrylic acid content of 9.6 percent by weight, with 0.25 percent by weight of IRGANOX 1010, 2.5 percent by weight of titanium dioxide and 0.5 percent by weight of copper phthalocyanine blue as pigmentation was melt-compounded in a 63.5 mm (2½") diameter NRM single-screw 30:1 L/D extruder at about 177° C. The resultant extrudate was cryogenically ground using liquid nitrogen and a MIKRO-PUL hammer mill and then screen classified with a ROTOTAP lab unit to provide a finely powdered resin composition with about 94 percent by weight of the particles in the size range of from about 37 to about 110 microns and 98 percent by weight of the particles in the size range of less than 177 microns.

The finely powdered thermoplastic resin composition was flame-sprayed onto a 610 mm×610 mm×3.2 mm (2'×2'×⅛") steel plate, previously grit blasted to an approximately 0.038 mm (1.5 mil) profile, using a KJ 200 Model flame-spraying gun (sold by Plastic Flame-coat Systems, Pearland, Tex.) and allowed to cool to a 0.508 mm (20 mil) coating. The application rate of the fine powder was 1.7 kg/min (3.75 lbs/min). The gun was fueled with propane at 52 kPa (7.5 psi) and oxygen at 3.4 kPa (0.5 psi) using air at 410 kPa (60 psi) as the carrying gas without inert gas shrouding. The Gardner impact strength of the coating was 29.8 N-m (22 ft-lbs) and the Dolly-Elcometer adhesiveness was >11 MPa (>1500 psi). The coating also showed no holidays (pinholes or voids) when spark tested at 2500 millivolts by a wet-sponge detector. The coating melt index was 2.6 dg/min.

Comparative Example VII

For comparative purposes, the same colored polymer as employed in Inventive Example V, but without the addition of IRGANOX 1010 as a thermal stabilizer, was ground and classified to the same particle size and size distribution, and flame sprayed at an equivalent application rate under similar conditions. The resultant coating was very brittle and easily disbonded (i.e., Dolly-Elcometer adhesiveness was less than 1.38 MPa (200 psi) when applied to a 610 mm×610 mm×3.2 mm (2'×2'×⅛") steel plate grit blasted to a 0.0381 mm (1.5 mil) profile with the KJ 200 flame-spraying gun). Also, the coating melt index was less than 0.5 dg/min, indicating severe cross-linking and degradation.

Comparative Example VIII

For comparative purposes, the same colored polymer employed in Inventive Example V, but without the addition of IRGANOX 1010, was ground and classified such that about 96% of the particles by weight were in the size range of from about 45 to about 300 microns with 68% by weight of the particles having a particle size less than 177 microns. This powdered composition was flame spray coated at an application rate of about 1.25 kg/min (2.25 lbs/min) with the KJ 200 flame-spraying gun under similar conditions. Dolly-Elcometer adhesion was less than 7.1 Mpa (1025 psi). The coating showed numerous holidays when spark-tested at 2500 mV and an attempt to eliminate the holidays by flame-polishing resulted in significant scorching, burning and obvious crosslinking. The coating melt index prior to flame-polishing was 1.85 dg/min, and less than 0.5 dg/min after flame-polishing.

Comparative Example IX

For comparative purposes, an unstabilized ethylene acrylic acid copolymer containing about 3 percent colorant by weight, 9.7 percent acrylic acid by weight and having a melt index of about 22 dg/min was ground and classified to provide 97.5 percent by weight of the particles by weight in the size range of from about 45 to about 300 microns with 72 percent by weight of the particles having a particle size <177 microns. The powdered resin composition was also flame-sprayed using a KJ 200 gun at an application rate of about 1.66 kg/min (3.66 lbs/min) at conditions similar to Inventive Example V. The Gardener impact strength averaged only 16.9 N-m (12.5 ft-lbs) for five independent determinations and the coating melt index was 20.5 dg/min. The coating showed several holidays when spark-tested at 2500 mV and two holidays after flame-polishing at polymer temperatures up to 192° C. as measured by an optical pyrometer.

Inventive Examples VI-VIII and Comparative Examples X-XVIII

Various polymers were formulated to contain 3 percent by weight of a mixture of 20 percent by weight copper phthalocyanine blue and 80 percent by weight titanium dioxide as colorants. Each of the coatings were applied to 610 mm×610 mm×3.2 mm (2'×2'×⅛") steel plate, grit blasted to a 0.0381 mm (1.5 mil) profile, with the KJ 200 flame-spraying gun as in Inventive Example V. Fused coating thickness was 0.033 mm (1.3 mils). The compositions and characteristics of the flame-sprayable powder compositions are given in Table III, and the properties of the resultant flame sprayed coatings in Table IV.

TABLE III

| | | —COO— Containing Monomer | | Melt Index, | Stabilizer | | Particle Size | |
|---|---|---|---|---|---|---|---|---|
| EXAMPLE | Polymer | Type | Wt % | dg/min | Type | Wt % | Range, microns | Wt % in Range |
| Inv. VI | EAA[a] | AA[d] | 20.3 | 312 | A[g] | 0.25 | 37-177 | 84 |
| | | | | | B[h] | | <177 | 84 |
| Comp. X | " | " | 20.3 | 312 | None | — | 37-177 | 86 |
| | | | | | | | <177 | 86 |
| Comp. XI | " | " | 20.3 | 312 | None | — | 37-297 | 89 |
| | | | | | | | <177 | 53 |
| Comp. XII | " | " | 19.8 | 1285 | None | — | 37-297 | 88 |
| | | | | | | | <177 | 46 |
| Inv. VII | LLDPE[b] | MAH[e] | 0.13 | 5.2 | A[g] | 0.10 | 37-105 | 98 |
| | | | | | C[i] | 0.025 | <177 | 100 |
| | | | | | D[j] | 0.20 | | |
| Comp. XIII | " | " | 0.13 | 5.2 | None | — | 37-105 | 98 |
| | | | | | | | <177 | 100 |
| Comp. XII | LLDPE[b] | MAHe | 0.13 | 5.2 | None | — | 37-210 | 98 |
| | | | | | | | <177 | 79 |
| Comp. XV | " | " | 0.11 | 25.2 | None | — | 37-210 | 98 |
| | | | | | | | <177 | 65 |
| Inv. VI | EMAA Ionomer[c] | MAA[f] | 11.4 | 2.3 | B[h] | 0.50 | 37-105 | 87 |
| | | | | | E[k] | 0.50 | <177 | 100 |
| Comp. XVI | EMAA | " | 11.4 | 2.3 | None | — | 37-105 | 90 |

TABLE III-continued

| EXAMPLE | Polymer | —COO— Containing Monomer Type | Wt % | Melt Index, dg/min | Stabilizer Type | Wt % | Particle Size Range, microns | Wt % in Range |
|---|---|---|---|---|---|---|---|---|
| | Ionomer[c] | | | | | | <177 | 100 |
| Comp. XVII | EMAA | " | 11.4 | 2.3 | None | — | 37-210 | 95 |
| | Ionomer[c] | | | | | | <177 | 71 |
| Comp. XVIII | EMAA | " | 12.1 | 15.9 | None | — | 37-210 | 93 |
| | Ionomer[c] | | | | | | <177 | 78 |

[a]Ethylene/acrylic acid copolymer containing 20.3 wt % acrylic acid.
[b]Linear low density ethylene/octene-1 copolymer containing 6.6 wt % octene-1.
[c]Ionomer of ethylene/methacrylic acid copolymer containing 12.2 wt % methacrylic acid. Ionomer was prepared from zinc stearate and contained 2.5 wt % zinc.
[d]Acrylic acid.
[e]Maleic anhydride. The maleic anhydride was reacted onto the LLDPE with a peroxide catalyst in a devolatilizing extruder.
[f]Methacrylic acid.
[g]Tetrakis(methylene(3,5-di-tert-butyl-4-hydroxyhydrocinnamate))-methane.
[h]Tri-mono nonyl phenyl phosphite.
[i]Distearyl thio-dipropionate.
[j]Tris(2,4-di-tert-butyl phenyl)phosphite.
[k]Citric acid.

TABLE IV

| Example | Application Rate, kg/min | Coating: Gardner Impact Strength, n-M | Dolly-Elcometer Adhesion, MPa | Melt Index dg/min | Pinholes or Voids | Appearance |
|---|---|---|---|---|---|---|
| Inv. VI | 3.98 | 48.8 | 10.34 | 285 | None | Smooth |
| Comp. X | 3.7 | <2.7 | <1.38 | 117 | Crazing | Crazing |
| Comp. XI | 2.47 | 32.6 | 8.45 | 196 | Several | Orange Peel |
| Comp. XII | 3.9 | 10.8 | >10.34 | 1080 | Few | Slight Orange Peel |
| Inv. VII | 1.38 | 21.7 | >10.34 | 4.6 | None | Smooth |
| Comp. XIII | 1.23 | <2.7 | <1.38 | 2.1 | Crazing | Crazing |
| Comp. XIV | 0.73 | 12.2 | 7.779 | 3.2 | Several | High Orange Peel |
| Comp. XV | 1.3 | 5.4 | >10.34 | 23.9 | Few | Slight Orange Peel |
| Inv. VI | 1.79 | 24.4 | >10.34 | 2.1 | None | Smooth |
| Comp. XVI | 1.72 | <2.7 | <1.38 | <0.5 | Cracking | Cracking |
| Comp. XVII | 0.93 | 13.6 | 9.58 | 1.7 | Several | Orange Peel |
| Comp. XVIII | 1.72 | 13.6 | >10.34 | 15.5 | Few | Slight Orange Peel |

The foregoing description of the invention is illustrative and explanatory thereof. Many variations in the materials, proportions and method of flame spraying, as well as in the illustrated details of the flame spraying apparatus, will occur to those skilled in the art in view of the foregoing description. It is intended that all such variations that fall within the scope and spirit of the appended claims be embraced thereby.

What is claimed is:

1. A method of flame spray coating a substrate surface with an adherent carboxyl-containing polyolefin, comprising the steps of:

forming a flame by supplying a continuous stream of fuel to a fuel discharge port of a flame-spraying nozzle at a rate to sustain combustion thereof;

pneumatically conveying fluidized, finely-divided carboxyl-containing polyolefin to said nozzle, said polyolefin comprising from about 0.1 to about 55 percent by weight of a carboxyl-containing monomer, discharging said fluidized polyolefin from said nozzle through said flame in an oxygen-lean environment having an oxygen content less than about 5 percent to form a molten polyolefin spray; and directing said spray onto a substrate surface to deposit a coating of said polyolefin thereon.

2. The method of claim 1, comprising supplying inert gas to said oxygen-lean environment.

3. The method of claim 2, wherein said inert gas includes nitrogen, helium, argon, carbon dioxide, steam or a combination thereof.

4. The method of claim 1, comprising supplying inert gas as at least a portion of gas for fluidizing said polyolefin.

5. The method of claim 1, comprising the step of forming an oxygen-lean gas shroud between said finely-divided polyolefin discharge and said flame.

6. The method of claim 1, wherein said polyolefin comprises a flame-sprayable particulate having a particle size distribution substantially between about 37 microns and about 177 microns.

7. The method of claim 6, wherein said finely-divided polyolefin comprises at least about 95 percent by weight having a particle size less than about 149 microns.

8. The method of claim 6, wherein said finely-divided polyolefin comprises at least about 95 percent by weight having a particle size less than about 74 microns.

9. A method of flame spray coating a substrate surface with an adherent carboxyl-containing polyolefin, comprising the steps of:

forming an annular flame tunnel by continuous combustion of fuel and an oxidizing gas;

discharging through said flame tunnel a centrally disposed stream of a finely-divided carboxyl-containing polyolefin to form a molten polyolefin spray, said finely-divided polyolefin having a particle size distribution substantially between about 37 microns and about 177 microns;

forming an annular oxygen-lean gas shroud between said polyolefin stream and said flame tunnel by continuously supplying an inert gas selected from the group consisting of nitrogen, helium, argon, carbon dioxide, steam and combinations thereof to form an oxygen-lean environment adjacent said polyolefin stream having an oxygen content less than about 5 percent, said inert gas supplied in a proportion of at least 0.75 on a weight basis relative to said oxidizing gas;

directing said spray onto a substrate surface to deposit a coating of molten polyolefin thereon; and allowing said polyolefin to cool into a continuous, hardened coating on said substrate, said coating having a melt index at least about 70% of the melt index of said finely-divided polyolefin prior to discharge through the flame tunnel.

10. The method of claim 9, wherein said substrate is metal and further comprising the step of pretreating said substrate surface by grit blasting to a profile of about 38–50 microns.

* * * * *